US005888047A

United States Patent [19]

Auerbach et al.

[11] Patent Number: 5,888,047

[45] Date of Patent: Mar. 30, 1999

[54] SEPARATING AND FEEDING MACHINE FOR BOUND BOOKLETS

[75] Inventors: David R. Auerbach, Redding; Rocco J. DiCrescenzo, New Milford; Joseph Guiles, Prospect; Richard F. Stengl, Wolcott, all of Conn.

[73] Assignee: Pitney Bowes Inc., Stamford, Calif.

[21] Appl. No.: 775,474

[22] Filed: Dec. 30, 1996

[51] Int. Cl.[6] ..... B65H 3/64

[52] U.S. Cl. ..... 414/797.8; 414/797.4; 271/124; 271/166

[58] Field of Search ..... 414/795.7, 797.4, 414/797.5, 797.6, 797.7, 797.8; 271/11, 104, 107, 121, 124, 161, 166, 167

[56] References Cited

U.S. PATENT DOCUMENTS

| | | | |
|---|---|---|---|
| 2,639,916 | 5/1953 | Anness | 271/124 |
| 3,034,784 | 5/1962 | Lopez | 271/104 |
| 3,151,863 | 10/1964 | Lohr | 271/166 |
| 3,874,655 | 4/1975 | Allen et al. | 414/797.8 |
| 4,010,944 | 3/1977 | Young | 271/166 |
| 4,630,812 | 12/1986 | Kano et al. | 414/797.8 |
| 4,718,809 | 1/1988 | Krouuski et al. | 414/797.4 |
| 5,465,110 | 11/1995 | Carlotta et al. | 347/104 |
| 5,601,282 | 2/1997 | Milo et al. | 271/121 |

*Primary Examiner*—Karen M. Young
*Assistant Examiner*—Gregory A. Morse
*Attorney, Agent, or Firm*—Christopher Capelli; Charles A. Malandra; Melvin J. Scolnick

[57] ABSTRACT

A separating and feeding machine is disclosed for removing a succession of bound booklets or the like from a supply hopper adapted to hold a stack of the booklets for feeding them to a subsequent apparatus for further processing. The separating and feeding machine includes a reciprocating vacuum feed plate disposed in the bottom of the hopper for advancing the bottom booklet through a discharge opening to a take away feed mechanism, and includes first and second stage separating mechanism which initially maintains at least the bottom two booklets in the hopper in shingled relationship to expose a marginal portion thereof adjacent the bound edge so that a pressing member can maintain a normal force on the exposed marginal portion of the bottom booklet to prevent it from wrinkling and becoming jammed in the discharge opening while the vacuum feed plate is moving it toward the discharge opening. The second stage separating separater further ensures that only one booklet at a time can pass through the discharge opening.

24 Claims, 8 Drawing Sheets

SEPARATING AND FEEDING MACHINE FOR BOUND BOOKLETS

BACKGROUND OF THE INVENTION

The present invention relates generally to document separating and feeding machines, and more particularly to a machine uniquely adapted for separating and feeding bound booklets seriatim from a stacked supply thereof for movement of the booklets to subsequent apparatus for further processing.

Machines for feeding documents seriatim from a stack thereof have long been well known and have been used in a variety of paper handling applications with great commercial success. Generally, machines of this type typically include a suitable hopper for holding a stack of documents, usually in substantially vertical orientation, with each document lying in a substantially horizontal plane. A suitable feeding mechanism separates a document from the top or bottom of the stack, depending on whether the machine is designed to feed from the top or bottom of the stack, and feed it from the stack to a suitable take away feeding device which further feeds the document to another apparatus for further processing.

Machines of this type are ideally suited for use in connection with various types of document processing systems which may typically include printing and separating machines for printing customized documents on a web and separating the documents into individual sheets, collating machines which form collations of a basic document, such as the customized printed document, and one or more items of additional insert material, accumulating machines for properly arranging the customized printed document or documents with all of the insert material, inserting machines for inserting the collations into envelopes, and mailing machine which close and seal the flaps of the envelopes, print a postage indicia thereon, and stack the envelopes for deposit with the Postal Service. There are, of course, other types of document processing operations which can be performed on the documents and/or insert material, such as printing, folding, scoring, etc. Thus, the type of document feeding apparatus of the type to which the present invention relates has widely diverse application in the general field of document handling and processing.

One very important characteristic of the individual components and machines that make up such a document processing system is that they must be capable of operating very reliably at a high rate of speed in order to justify the relatively high cost of purchasing and maintaining these components and machines.

Extensive experience has shown that document separating and feeding machines of the type to which the present invention is related have achieved a high degree of design refinement and have proven to be highly successful in virtually all of the commercial applications for which they were intended. There are a number of different design concepts for these feeders, such as feeding from the top or bottom as mentioned above, and utilizing friction roller or reciprocating friction pusher feed elements, vacuum lift or vacuum pusher feed elements, grippers, clamp type devices, and all are used depending on the type of documents being handled and the manner in which the feeder best fits into the overall processing system.

One exception to the general degree of commercial success and acceptance of these document separating and feeding machines is in the field of handling bound booklets, and particularly bound booklets that are formed of relatively cheap, low grade paper that is thin, flexible, and/or flimsy, and in feeding such booklets through the discharge opening of a bottom feed type separating and feeding machine. Depending on certain preferences of the originators of the booklets and the nature of the booklets themselves, some are printed on relatively expensive, substantially high grade paper which has a substantial degree of rigidity and resistance to wrinkling or rumpling, as well as a relatively smooth surface texture with a low coefficient of friction. They also may be formatted to have relatively small dimensions. Such booklets can be fed almost as if they are single sheets of relatively stiff material, and few problems are encountered in feeding such booklets with most commercially available bottom type feeding machines. However, in many other situations, booklets are printed on the relatively inexpensive, low quality paper, which typically is very thin and flimsy, has relatively little rigidity and therefore wrinkles or rumples easily when handled, and may also have a relatively coarse surface texture with a high coefficient of friction, and therefore cannot be separated and fed by commercially available separating and feeding machines with the required degree of reliability for commercial success. Booklets printed on this type of paper typically crumple in response to the feeding forces imposed on the booklets by virtually all of the known bottom feed document separating and feeding machines, and tend to jam in the discharge openings of such machines.

More particularly, the main problem encountered in separating and feeding any type of bound booklet from the bottom of a stack thereof is that the feeding element exerts a normal force adjacent the location of the feeding element on the bottom cover or outer sheet of the booklet, and also exerts a forward directional force on the bottom cover or outer sheet. Typically, the normal force from the feeding element is localized in the area of the feeding element and is not of sufficient magnitude to be distributed throughout the booklet, especially at the leading or bound edge thereof. If the booklet is made from good quality paper, and possesses the rigidity and size characteristics mentioned above, the lack of normal force at the lead edge of the booklet by the feeding element will not present a problem because the paper has sufficient rigidity, especially in a small format, to retain its shape. Thus, when sufficient directional force is applied by the feeding element to the cover or outer sheet of the booklet to overcome the frictional resistance to movement of the opposite cover or outer sheet with the cover or outer sheet of the adjacent booklet, the entire booklet will move and will feed from the bottom of the stack without jamming in the discharge opening of the separating and feeding machine. The booklet will, in effect, move as if it were simply a single sheet of relatively thick and rigid material.

On the other hand, if the booklet is made of low quality paper having the characteristics mentioned above, and particularly if it is made to a large format such as standard 8½ by 11 inches, and because the normal force from the feeding element is localized and not directed at the leading bound edge of the booklet, when the forward directional force from the feeding element moves the cover or outer sheet of the booklet, the remaining sheets and the opposite cover or outer sheet tend to remain in place in the stack due to the frictional resistance described above. This will cause the cover and any outer sheets that do commence movement to rumple and curve out of alignment, and the booklet will jam at the discharge opening of the separating and feeding machine. This can even occur in some types of top feeding machines which have discharge openings, but it is more likely to occur in a bottom type separating and feeding machine where the weight of the stack of booklets pressing on the bottom booklet would amplify the amount of normal force on substantially the entire area of the bottom booklet except at the leading edge. This further increases the tendency for the leading or bound edge of the booklet to remain in place while the lower portion of the booklet begins to move, thereby further increasing the likelihood that the lead edge of the booklet will rumple and curve upwardly and jam in the discharge opening.

Thus, it is apparent that there is a need for a document separating and feeding machine that is capable of separating and feeding bound booklets from the bottom of a stack thereof which are formed of relatively low quality, thin, flexible and flimsy paper at a substantial rate of speed and with a high degree of reliability.

BRIEF SUMMARY OF THE INVENTION

The present invention provides a separating and feeding machine for bound booklets that substantially obviates, if not entirely eliminates, the disadvantages and shortcomings of prior art bound booklet separating and feeding machines. When dealing with booklets which are printed on low quality paper having the disadvantages described above and in a relatively large format, it has been discovered that, by utilizing the principles of the present invention, the bottom booklet of a stack of such booklets can be withdrawn from beneath the stack and fed through a discharge opening without any relative movement between different portions of the booklet, and therefore without the leading bound edge of the booklet curling up and causing a jam at the discharge opening. This is accomplished by utilizing a reciprocating vacuum feed device on the bottom booklet, with the vacuum being applied as close as possible to the bound edge of the booklet, combined with shingling at least the bottom two booklets so that a normal force can be simultaneously applied to the opposite side of the booklet from the vacuum feed device. With this arrangement, the bound edge of the booklet can be very effectively separated from the booklet above it, and the combination of the applied normal force on top and the vacuum below is sufficient to cause the vacuum feed device to move the entire booklet through a discharge opening without any part of the booklet separating from another part and curling it to cause a jam.

The booklet separating and feeding machine of the present invention is designed to feed a succession of bound booklets or the like from a supply hopper adapted to hold a vertically oriented stack of the booklets to another apparatus for further processing of the booklets. In this environment, the separating and feeding machine of the present invention comprises a supply hopper for holding a stack of the booklets, the supply hopper having upstanding front, rear and side walls and a bottom supporting plate, the booklets being disposed in the hopper with the bound edges thereof facing the front wall, There is means operatively associated with the front wall defining a discharge opening from the supply hopper adjacent the bottom supporting plate, and a take away feeding means mounted adjacent the discharge opening for grasping the bound edges of the booklets as they pass through the discharge opening. A vacuum feeding means is movably mounted on the supporting plate for grasping the bottom booklet of the stack closely adjacent the bound edge thereof and moving the bottom booklet sufficiently far through the discharge opening for the take away feeding means to grasp the bound edge to withdraw the booklet from the hopper. A booklet separation means is operatively associated with the supply hopper has a first stage separating means for simultaneously obstructing movement of the next to bottom booklet while the bottom booklet is moving through the discharge opening, and maintaining a normal force on the bottom booklet adjacent the bound edge thereof during movement of the bottom booklet through the discharge opening, and a second stage separating means for permitting only one booklet at a time to pass through the discharge opening. With this arrangement, successive bottom booklets can be fed seriatim from the stack to the take away feeding means without becoming wrinkled and jamming in the discharge opening.

In some of its more limited aspects, the vacuum feeding means includes a vacuum feed plate and means mounting the vacuum feed plate for limited reciprocatory movement relative to the discharge opening between a first position in which the vacuum feed plate grasps the bottom booklet adjacent the bound edge thereof and a second position in which the take away feeding means grasps the bound edge of the booklet. Suitable control means causes the vacuum to be applied to the feed plate at the commencement of a forward movement and to be interrupted when the take away feeding means grasps the lead edge of the booklet.

The first stage separating means comprises means for maintaining at least the bottom and next to bottom booklets of the stack in a shingled relationship to expose a marginal portion of the top sheet of the bottom booklet adjacent the bound edge thereof, and means for maintaining a normal force on the exposed edge during movement of the booklet toward the discharge opening. The means for maintaining the bottom and next to bottom booklets in a shingled relationship is adjustable to accommodate booklets of varying thickness, and the means for maintaining the normal force on the exposed edge portion of the bottom booklet is adjustable to vary the extent of the normal force applied to the lead edge portion of the bottom booklet.

The second stage separating means comprises a vertically adjustable gate mounted adjacent the discharge opening to further ensure that only one booklet at a time can pass through the discharge opening.

Having briefly described the general nature of the present invention, it is a principal object thereof to provide a separating and feeding machine that is uniquely designed for separating and feeding a succession of bound booklets from the bottom of a stack thereof held in a hopper and which are formed of relatively thin, flexible and flimsy paper, and in a relatively large format, with high reliability against any booklet jamming at the discharge opening of the hopper.

It is another object of the present invention to provide a separating and feeding machine for feeding bound booklets formed of low quality paper in which at least the bottom two booklets are maintained in a shingled relationship, and a normal force is maintained on the leading edge of the bottom booklet to ensure that it does not jam at the discharge opening.

It is still another object of the present invention to provide a separating and feeding machine for feeding bound booklets formed of low quality paper in which the supply of booklets in the hopper can be replaced without interrupting the flow of booklets being fed from the bottom of the hopper.

A further object of the present invention is to provide a separating and feeding machine for feeding bound booklets formed of low quality paper in which the rear edges of the booklets in the stack are maintained in an elevated position with respect to the bottom booklet so as to maintain a substantial portion of the weight of the stack of booklets off of the bottom booklet.

It is yet another object of the present invention to provide a separating and feeding machine for feeding bound booklets of low quality paper in which the size of the discharge opening can be varied to accommodate the feeding of booklets of varying thickness.

These and other objects and features of the present invention will become more apparent from an understanding of the following detailed description of a presently preferred embodiment of the invention when considered in conjunction with the accompanying drawings.

DETAILED DESCRIPTION OF THE INVENTION

Figure 1:
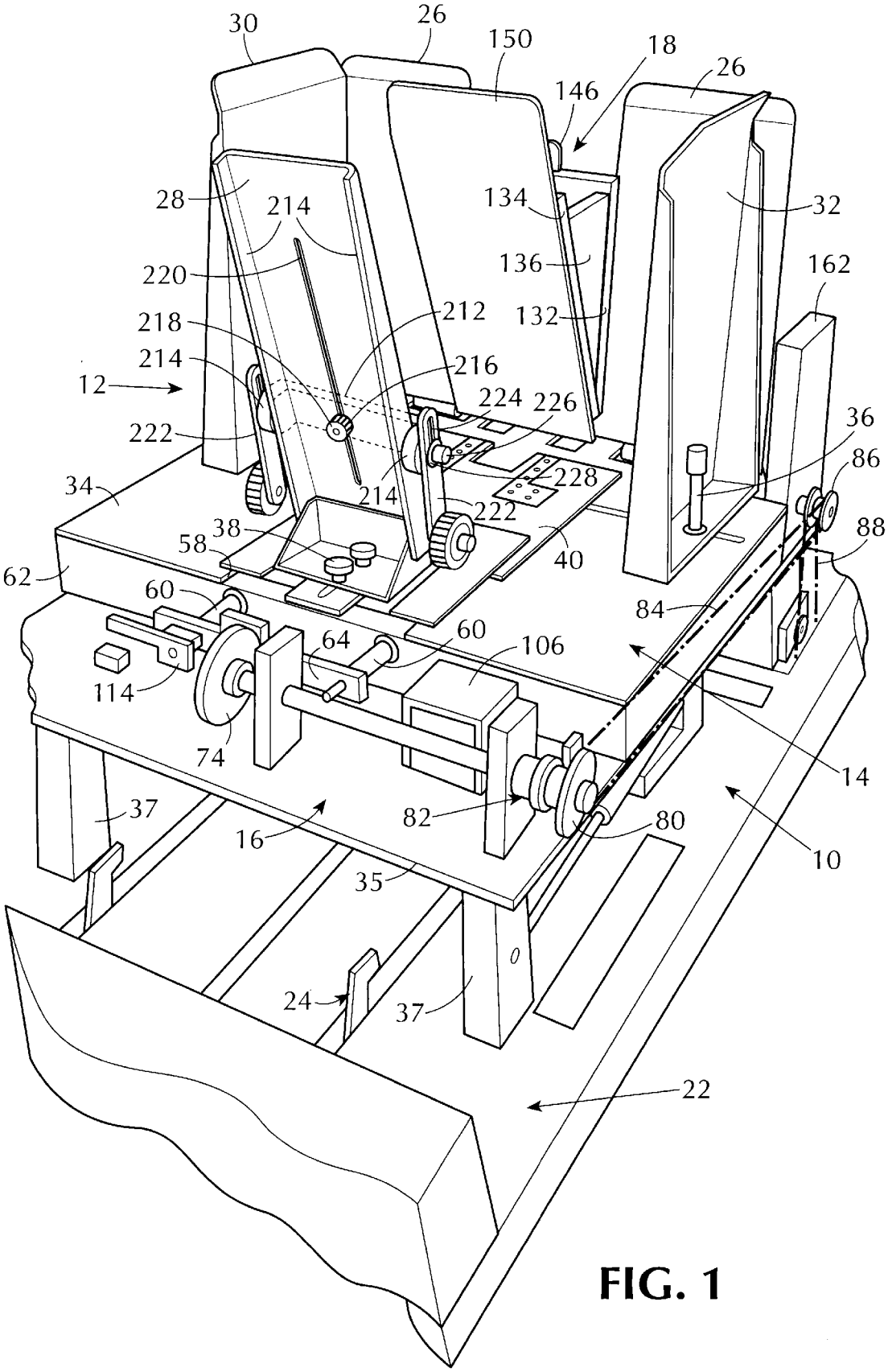
FIG. 1 is a perspective view of the separating and feeding machine of the present invention, looking toward the rear portion of the machine and showing details of the rear side of the supply hopper and the vacuum feeding means.
Figure 2:
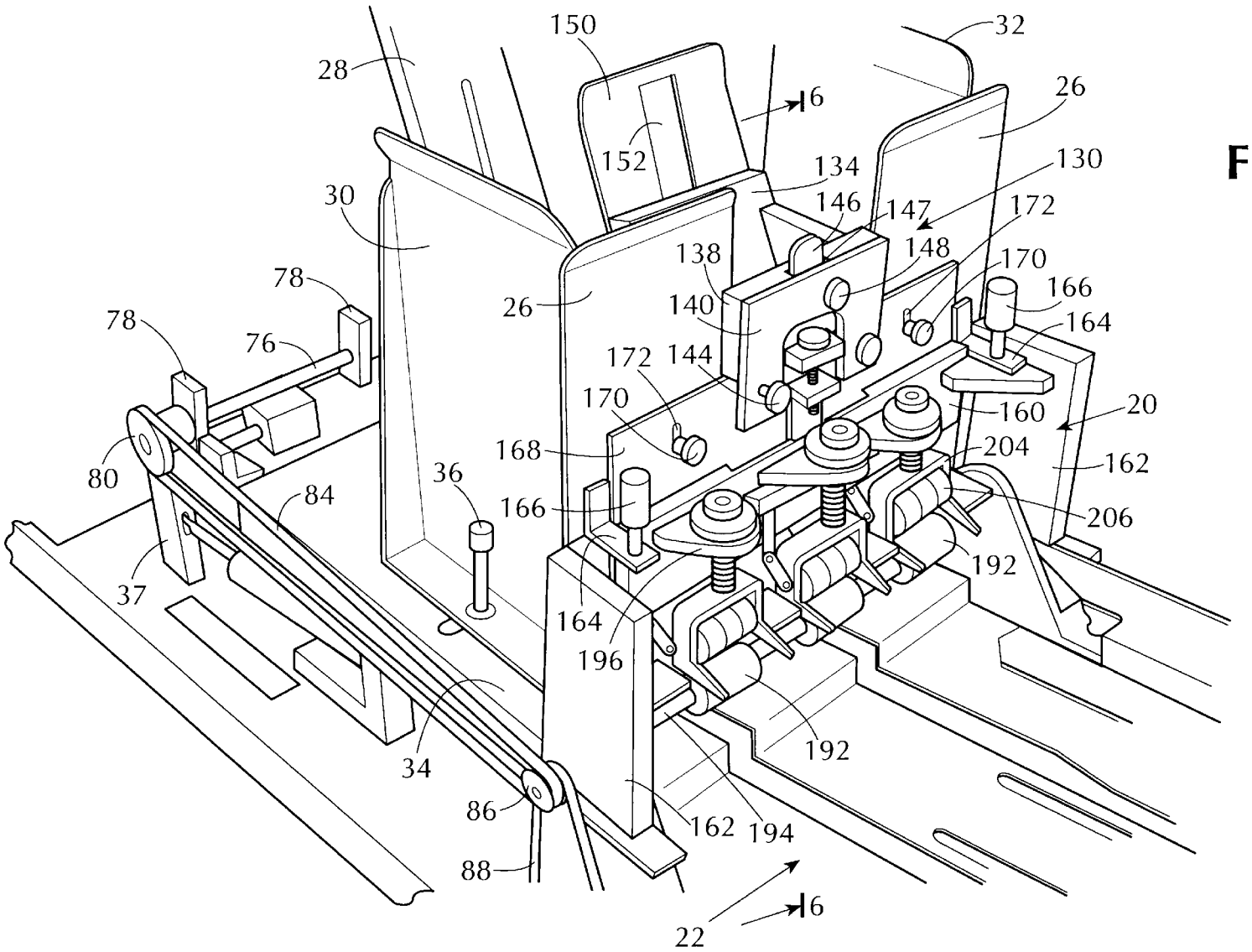
FIG. 2 is a perspective view of the separating and feeding machine of the present invention, looking toward the front portion of the machine and showing details of front side of the supply hopper, the separating means and the take away feeding means.

Referring now to the drawings, and particularly to FIGS. 1 and 2 thereof, the separating and feeding machine of the present invention is indicated generally by the reference numeral 10, and is seen to comprise a document storage hopper component, indicated generally by the reference numeral 12, a vacuum feeding component disposed adjacent the bottom of the supply hopper 12, indicated generally by the reference numeral 14, a drive assembly for operating the vacuum feeding component 14, indicated generally by the reference numeral 16, a stacking and separating component disposed in the supply hopper 12, indicated generally by the references numeral 18, and a take away feeding component disposed on the outside of the hopper adjacent a lower corner thereof, indicated generally by the reference numeral 20 (FIG. 2). The construction and operation of the separating and feeding machine 10 will be better understood by considering each of these components in detail in the order just described.

It should be understood at the outset that the separating and feeding machine 10 is itself one component of a rather large and complex high speed multi-function document processing apparatus as briefly described above, indicated generally by the reference numeral 22, only a small part of which is shown in the drawings because it forms no part of the present invention. It is only necessary to note that the document processing apparatus 22 forms collations of different types of insert materials gathered from suitable document feeders spaced along an elongate insert material conveyor, again a small portion of which of shown in FIGS. 1 and 2 and indicated generally by the reference numeral 24 (FIG. 1) . Thus, the conveyor 24 moves insert material along from other upstream insert material feeding devices and moves it beneath the separating and feeding machine 10 of the present invention so that the booklet documents in the device 10 can be added to the collations, which are then moved further on by the conveyor 24 for further processing. It should be understood that the separating and feeding machine 10 can also be used by itself as a stand alone machine to feed booklet documents which are not accompanied by other insert material.

The document supply hopper 12 comprises a plurality of upstanding walls, including a bifurcated front wall 26, a rear wall 28 and side walls 30 and 32, and a bottom supporting plate 34. The plate 34 is suitably supported on another larger plate 35 which, in turn, is suitably supported as by legs 37 on a portion of the document processing apparatus 22. All of the parts and components of the machine 10 are supported either on the plate 34 or the plate 35 as hereinafter described. The walls 26, 28, 30 and 32 are shown as separate upstanding partitions, so as to leave ample space between the individual walls for manual loading of the hopper with a stack of documents, which as previously explained, are bound booklets formed of relatively thin, flexible paper, which tends to make the booklets flimsy and difficult to handle. Thus, the configuration of the walls, as best seen in FIG. 1, affords maximum accessibility to the documents in stacking them in the hopper and ensuring that they are evenly stacked. The side walls 30 and 32 are adjustably secured to the plate 3 as by bolts 36 which permit the side walls to be adjusted laterally to accommodate booklets of varying height. The rear wall 28 is similarly secured to the bottom plate 34 by bolts 38 which permit the rear wall 28 to be adjusted longitudinally to accommodate booklets of varying width. It will be understood that since the separating and feeding machine 10 is of the bottom feed type, as will be further seen hereinafter, booklets can be constantly added to the top of the supply hopper 12 during operation of the machine 10.

Figure 3:
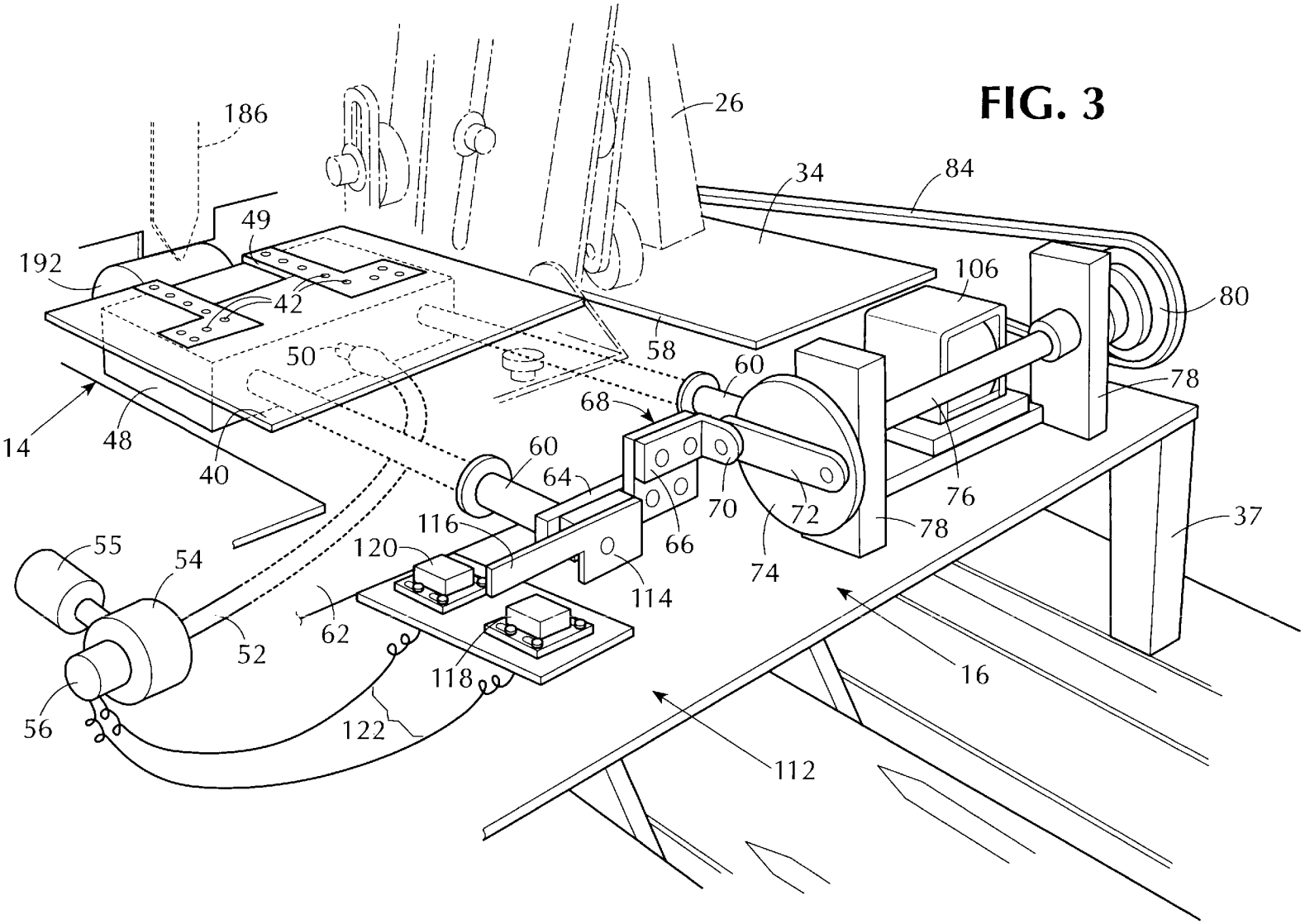
FIG. 3 is a fragmentary perspective view of the rear portion of the machine shown in FIG. 1, illustrating further details of the vacuum feeding means, and the mechanism for moving the vacuum feeding means.
Figure 6:
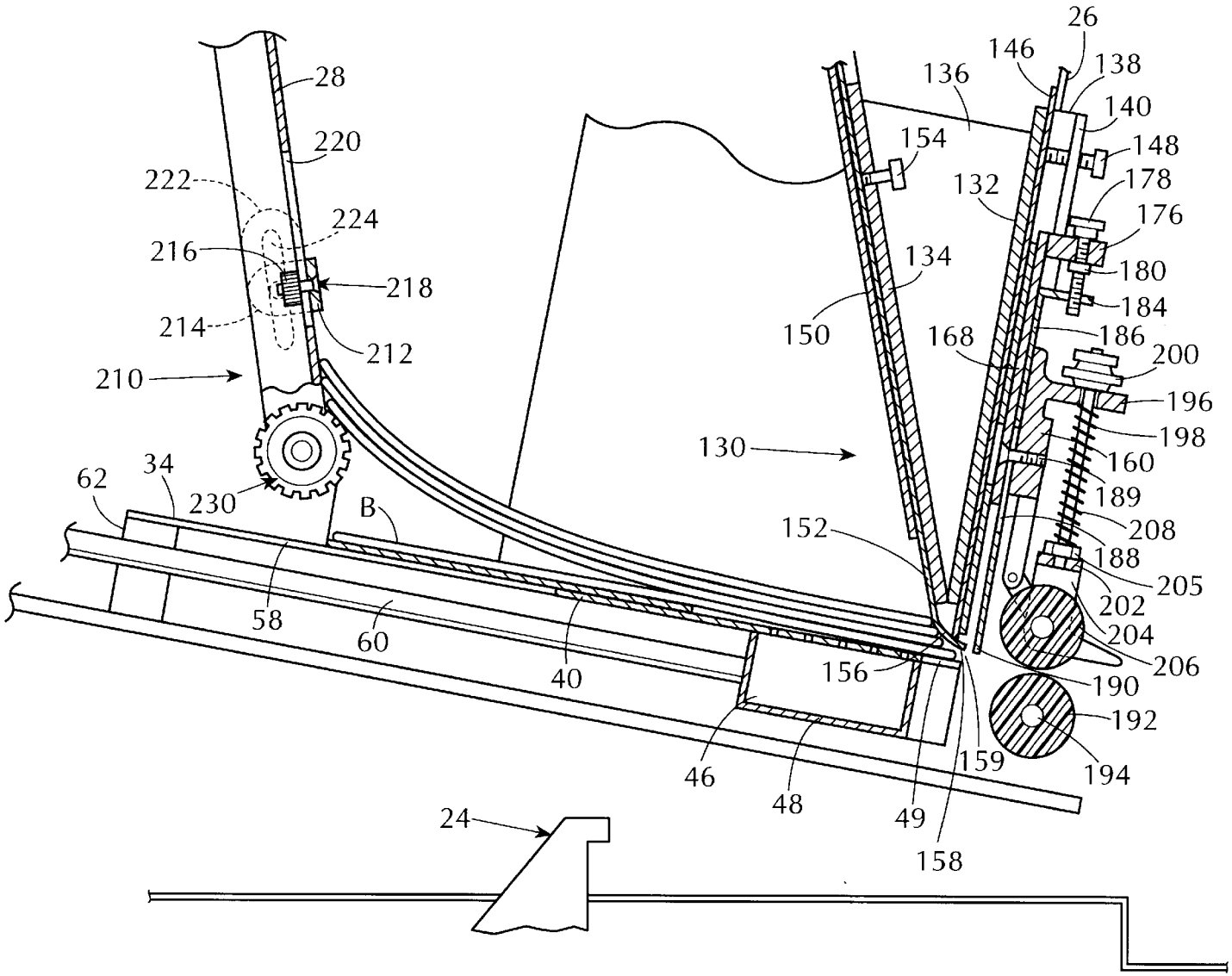
FIG. 6 is a fragmentary sectional view taken on the line 6—6 of FIG. 2 showing details of the first and second stage separating elements of the stacking and separating component mounted on the front wall of the hopper adjacent the bottom supporting plate.

With reference to FIGS. 1, 3 and 6 through 10, the vacuum feeding component 14 comprises a flat, approximately square vacuum plate 40 which occupies a substantial portion of the bottom of the supply hopper 12, as best seen in FIG. 1, so that, as best seen in FIG. 6, the vacuum plate 40 will support a generally corresponding portion of the lower sheet or cover of the bottom booklet B in the stack, the plate 34 supporting the remaining portion of the bottom booklet B. As best seen in FIG. 3, the vacuum plate 40 is provided with a plurality of apertures 42 extending therethrough, and communicating with a vacuum chamber 46 (FIG. 6) which is defined by a suitable rectangular enclosure 48 secured to the underside of the vacuum plate 40. It will be seen that the apertures 42 extend from a location adjacent the front edge of the plate 40 rearwardly in two spaced apart parallel rows, with additional laterally spaced apertures adjacent the rear end of the rows. This arrangement provides room for the slot 49 formed in the front portion of the vacuum plate 40 to accommodate a roller 192, that is part of the take away feeding component 20 and further described below, when the vacuum plate 40 and associated parts move toward their forward most position. The enclosure 48 is provided with a fitting 50 in the rear wall thereof, to which a hose 52 is connected, the other end of which is connected to a suitable vacuum pump 54 driven by a suitable motor 55 (FIG. 3). The hose 52 is alternately either connected to the vacuum pump 54 or is vented to atmosphere by a suitable control element 56 which, when appropriately activated as more fully described hereinbelow, controls the application of vacuum to the vacuum chamber 48 and the apertures 42.

The vacuum plate 40 and the enclosure 48 for the vacuum chamber 46 are mounted on the supporting plate 34 for limited reciprocatory movement in a longitudinal direction, and are moved by the drive assembly 16. Thus, as best seen in FIGS. 1, 3 and 6, the vacuum plate 40 rests on the support plate 34 in sliding engagement therewith, the supporting plate 34 being provided with an elongate slot 58 to accommodate the enclosure 48 for the vacuum chamber 46. A pair of rods 60 are suitably mounted in a vertically oriented frame piece 62 for reciprocatory movement, the forward end of the rods 60 being fixedly connected to the rear wall of the enclosure 48 so that the rods 60, the enclosure 48 and the vacuum plate 40 all move as a unit by the drive assembly 16 in a manner yet to be described.

As best seen in FIGS. 1 to 3, the rear ends of the rods 60 are connected to a cross bar 64 to which one leg 66 of an L-shaped lever indicated generally by the numeral 68 is attached, the other leg 70 being connected to one end of an eccentric lever 72, the other end of which is eccentrically connected to a wheel 74. Thus, it will be apparent that rotation of the wheel 74 will cause reciprocatory movement of the bracket 68 which in turn will cause reciprocatory movement of the cross bar 64, the rods 60, the vacuum chamber enclosure 48 and the vacuum plate 40.

The wheel 74 is fixedly mounted on a shaft 76 which is rotatably mounted in a pair of upstanding support members 78, the shaft 76 being turned by a pulley 80 connected to the opposite end of the shaft 76 through a one revolution slip clutch assembly indicated generally by the reference numeral 82 (FIG. 1), and more fully described below. The pulley 80 is driven by a belt 84 which in turn is driven by another pulley 86 that is driven by a belt 88 that is driven by a suitable motor mounted on the document processing apparatus 22.

Since the pulleys 80 and 86 and the belt 84 are continuously driven, means must be provided to convert the continuous motion of the pulley 80 to intermittent motion of the shaft 76 in order to move the vacuum chamber enclosure 48 and the vacuum plate 40 at predetermined timed intervals to cause the separating and feeding machine 10 to feed booklets in timed synchronism with the arrival of other insert material at the machine 10 so as to add the booklets to the other insert material to form the desired collation. This motion conversion can be accomplished by any suitable mechanism that will start and stop the shaft 76 in response to signals from a microprocessor that is a part of the control system of the document processing apparatus 22. In the arrangement shown in the drawings, and with reference to FIGS. 1 and 3 through 5, the output element 90 of the slip clutch assembly 82 is fixedly mounted on the shaft 76, and the input element 92 is fixedly mounted on a stub shaft 94 that extends outwardly beyond the end of the shaft 76 on which the pulley 80 is fixedly mounted. Without any restraint on the output element 90 of the clutch assembly 82, there is sufficient friction between the input element 92 and the output element 90 to drive the output element 90 and the shaft 76 therewith.

Figure 4:
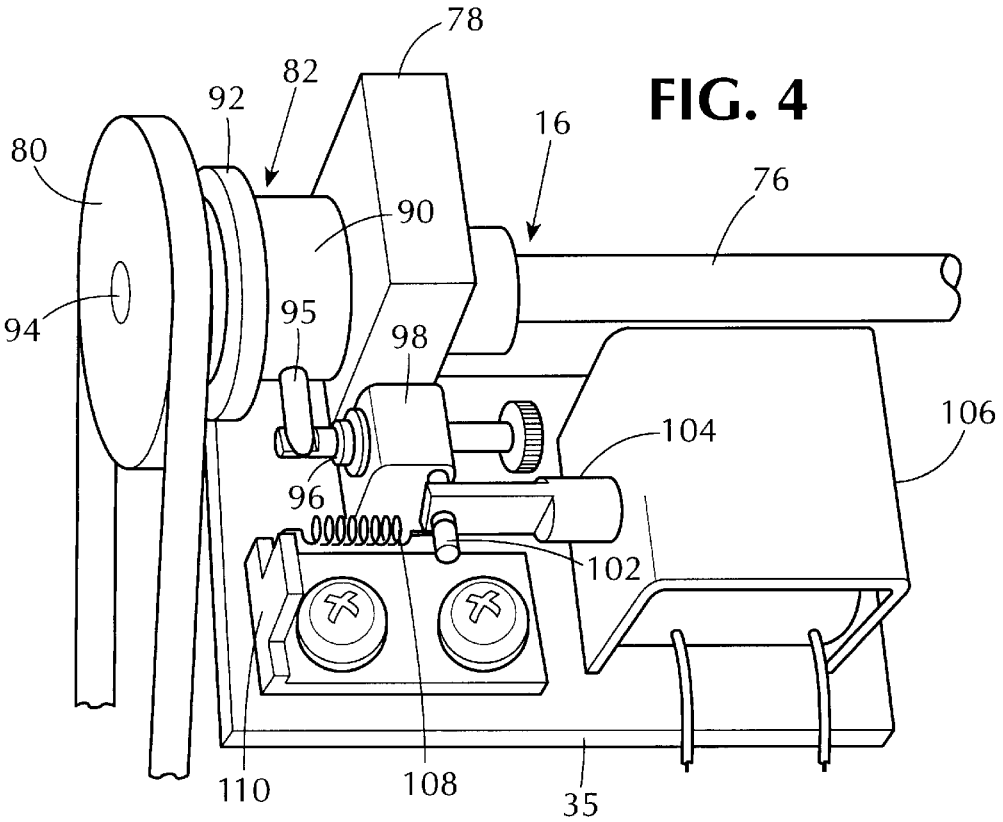
FIG. 4. is a fragmentary perspective view of the one revolution clutch component of the drive means for the vacuum feeding means, showing the parts in the position they occupy prior to commencement of a feeding cycle of the vacuum feeding means.
Figure 5:
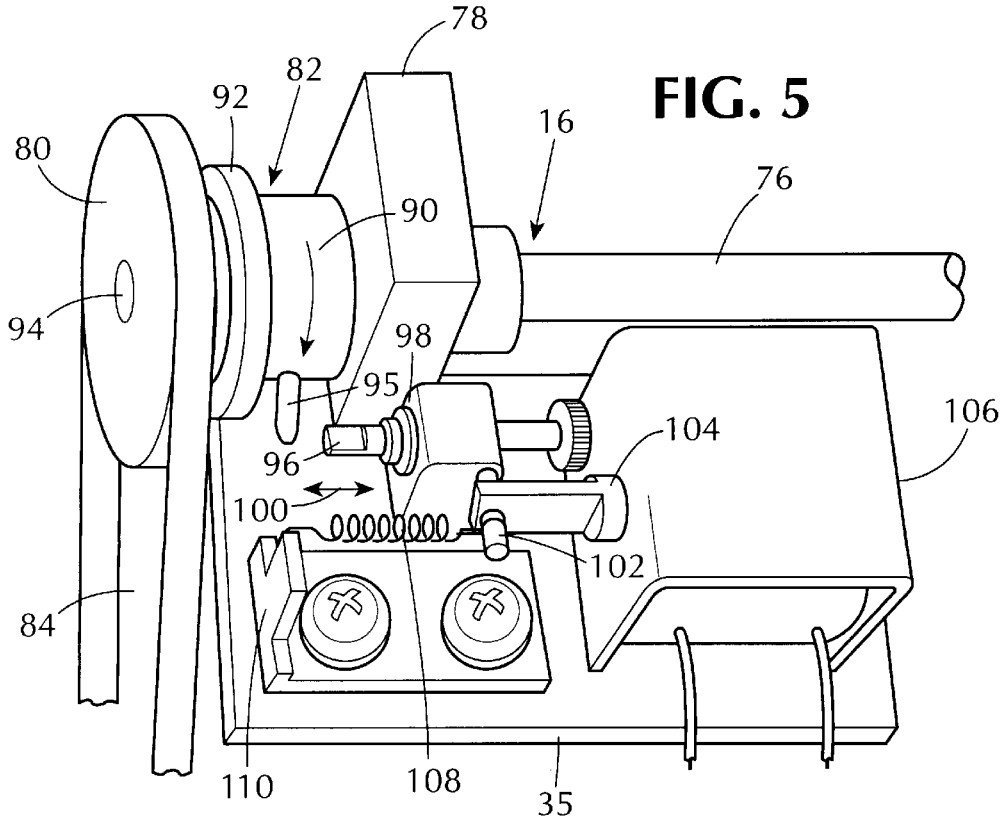
FIG. 5 is a view similar to FIG. 4 showing the parts in the position they occupy during a feeding cycle of the vacuum feeding means.

However, the output element 90 is provided with a radially extending pin 95 which normally engages with another pin 96 which is fixed in a block 98 that rests on the plate 35 so that it can move back and forth in the direction of the double ended arrow 100 seen in FIG. 5. Another pin 102 projects laterally from the block 98 and is connected to the plunger 104 of a solenoid 106 so as to be movable therewith. The pin 102 is normally urged toward the left, as viewed in FIGS. 4 and 5, by a tension spring 108 which is interconnected between the laterally projecting pin 102 and a bracket 110 suitably secured to the plate 35, so as to maintain the pin 96 in engagement with the pin 95, as seen in FIG. 4, thereby preventing movement of the pin 95 and the output element 90 of the slip clutch assembly 82. However, when the solenoid 106 is energized, the plunger 104 is moved toward the right against the bias of the spring 108, which moves the block 98 toward the right to withdraw the pin 96 from engagement with the pin 95 projecting from the output element 90, as shown in FIG. 5. This permits the pin 95 to move so that the output element 90 can rotate in response to the urging of the frictional engagement between the input and output elements 92 and 90, which in turn rotates the shaft 76. In operation, the solenoid is deenergized during the first rotation of the output element 90 and shaft 76 so that the pin 96 returns to the normal position shown in FIG. 4, with the result that movement of the pin 95, the output element 90 and the shaft 76 is stopped as soon as one revolution of these parts has been completed. Thus, it will be seen that operation of the solenoid 106, as controlled by a signal from the microprocessor component of the control system of the document processing apparatus 22, in turn controls the timing of the reciprocatory movement of the vacuum plate 40.

In order to move a booklet from the normal storage position in the hopper 18 to the take away feeding device 20, as further explained below, it is necessary to operate the vacuum control element 56. This is accomplished by means of a vacuum timing device, indicated generally by the reference numeral 112, which is operated by a portion of the vacuum plate driving assembly 16 just described. With particular reference to FIG. 3, it will be seen that a suitable flag 114 is mounted on the cross bar 64 for movement therewith, the flag 114 having an arm portion 116 which is positioned alternately over one or the other of a pair of optical sensors, a rearward sensor 118 and a forward sensor 120. The sensors 118 and 120 are suitably electrically connected to the vacuum control element 56 through the wires 122. Thus, the arrangement is such that when the arm 116 of the flag 114 is recognized by the rearward sensor 118, the vacuum control element 56 connects the pump 54 to the hose 52 so as to apply a vacuum to the vacuum chamber 46 and hence apertures 42 in the vacuum plate 40, thereby causing the bottom booklet B in the hopper to adhere to the vacuum plate 40. When the arm 116 is moved to the forwardmost position so as to be recognized by the forward sensor 120, the vacuum control element 56 disconnects the hose 52 from the pump 54 and connects it to atmosphere so that the vacuum in the chamber 46 is vented, thereby releasing the bottom booklet from the vacuum plate 40. This is further described below in connection with a description of the operation of the entire separating and feeding machine 10. It should be noted that, in actual practice, the sensing devices 118 and 120 are mounted on the plate 35 in any convenient manner so as to be adjustable in the direction of movement of the flag 114 to afford precise timing of the application and interruption of the vacuum to the apertures 42.

Figure 8:
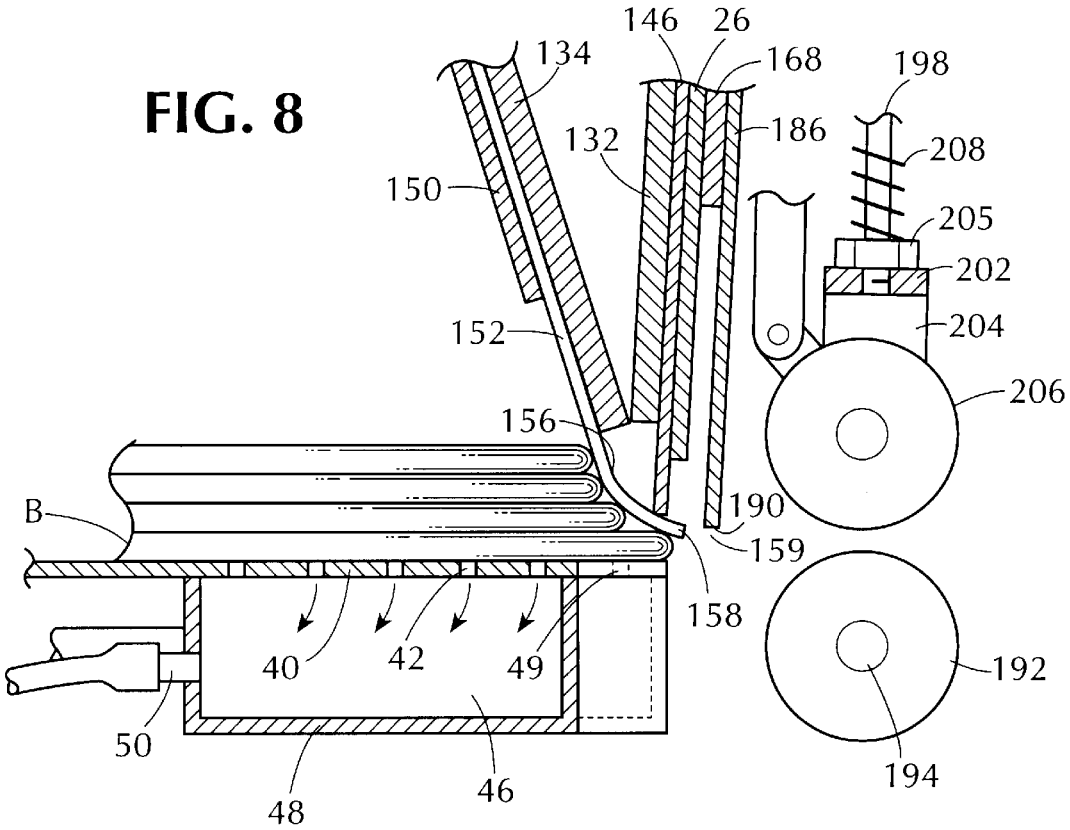
FIG. 8 is a view similar to FIG. 7, showing the features of the present invention that maintain sufficient normal force on the lead edge portion of the bottom booklet as it is being fed through the discharge opening to prevent the jamming condition illustrated in FIG. 7, showing the position of the vacuum feeding means prior to commencement of a feeding cycle.
Figure 9:
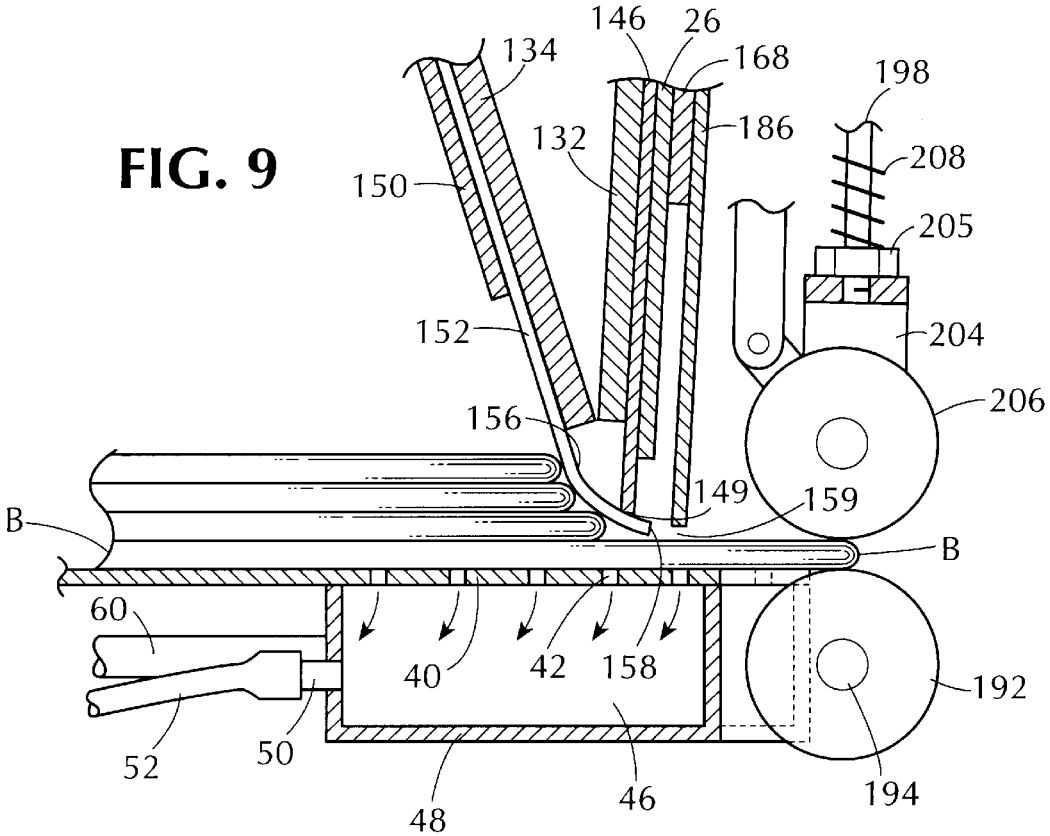
FIG. 9 is a view similar to FIG. 8 showing the position of the vacuum feeding means when the leading edge portion of the bottom booklet has been fed through the discharge opening and grasped by the take away feeding means.
Figure 10:
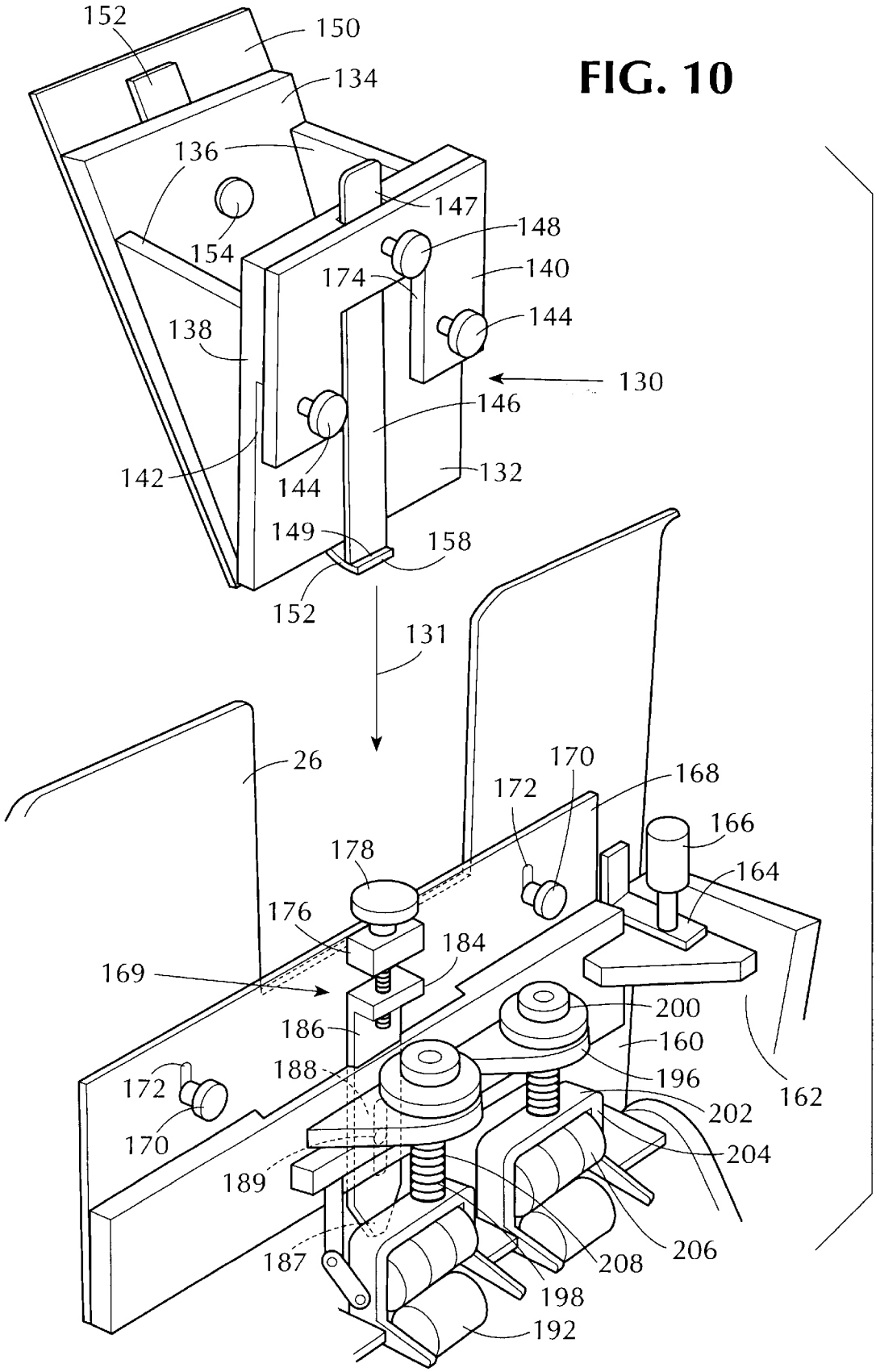
FIG. 10 is a fragmentary exploded view of the front portion of the supply hopper showing a portion of the take away feeding means and the first and second stage separating means, with the first stage separating means being shown separated from the front wall of the supply hopper.

With reference to FIGS. 2 and 6 through 10, the document stacking and separating components 18 comprises a unitary first stage separating device, indicated generally by the reference numeral 130 in FIGS. 6 and 10, and comprises a front substantially vertical wall 132, a rear wall 134 which is angled rearwardly from the bottom to the top, and a pair of side walls 136 which are connected to the front and rear walls 132 and 134 to form the unitary, triangular shaped device 130. The front wall 132 includes a widened upper portion 138 to which a bifurcated mounting plate 140 is suitably secured as by bonding, the mounting plate 140 extending down below the bottom edge of the widened portion 138 of the front wall 132 so as to leave a lateral slot 142 extending across the width of the front wall 132. A pair of bolts 144 are threaded into the legs of the front wall 140 for a purpose described below. Also, a vertically oriented pressing member 146 is mounted in a groove 147 in the mounting plate 140 and is held therein by a screw 148 that is threaded into the mounting plate to lock the pressing member 146 in a given vertical position for a purpose described below.

The unitary first stage separating device 130 also includes a booklet guide plate 150 which is suitably secured to the rear wall 134, and as best seen in FIG. 1, extends from a point adjacent the bottom plate 34 to approximately the same height as the upstanding walls of the supply hopper 12. An elongate strip 152 is suitably captured between the rear surface of the rear wall 134 and the forward surface of the booklet guide plate 150, and is adjustably secured thereto by a bolt 154 (FIG. 6) which is threaded into the rear wall 134 and which presses the strip 152 against the forward surface of the guide plate 150. As best seen in FIGS. 6 and 10, and in the enlarged views shown in FIGS. 8 and 9 further described below, a bottom portion 156 of the strip 152 is provided with a forward curvature that terminates as at 158 in closely vertical spaced relationship with the upper surface of the vacuum feed plate 40 so as to define a discharge opening 159 between the end 158 and the upper surface of the vacuum feed plate 40. It should also be noted that the upper surface of the lower end 149 of the pressing member 146 is in contact with the upper surface of the curved portion 156 adjacent the end 158 thereof, for a purpose yet to be described.

The aforementioned entire first stage stacking and separating device 130 is mounted on the front wall 26 of the hopper assembly 12 in the space between the bifurcated portions of the front wall 26, as indicated by the arrow 131. Thus, as best seen in FIG. 2, an elongate casting 160 extends laterally across the forward portion of the supply hopper 12 and is suitably secured to upstanding side frame members 162. A pair of L-shaped brackets 164 are secured to the casting 160 adjacent the side frame members 162 by means of bolts 166 that are threaded into the casting 160. The brackets 164 are also suitably fixedly secured to the front wall 26, thereby securing the front wall 26 to the casting 160.

A laterally extending cross bar 168 is secured to the bifurcated portions of the front wall 26 by means of the bolts 170 which pass through vertically oriented slots 172 in the cross bar 168 and are connected to the front wall. The slots 172 permit a limited amount of vertical adjustment of the cross bar 168 when the bolts 170 are loosened and retightened, the purpose for which is more fully explained below. Thus, the cross bar 168 is effectively connected to the casting 160 by virtue of being rigidly secured to the front wall 26 which, in turn, is rigidly connected to the casting 160.

As best seen in FIGS. 2 and 10, the first stage stacking and separating device 130 is brought down onto the cross bar 168, an upper part of which fits into the laterally extending slot 142, so that the depending legs of the mounting plate 140 are disposed on the outer surface of the cross bar 168 and the front wall 132 of the device 130 is disposed on the inner surface of the cross bar 168. The device 130 is secured in this position by the bolts 144 being tightened against the outer surface of the cross bar 168. which effectively rigidly connects the stacking and separating device 130 to the casting 160. The vertical position of the device 130 can be adjusted by adjusting the vertical height of the cross bar 168 as described above for a purpose described below.

With reference still to FIGS. 2, 6 and 10, the document stacking and separating component 18 further includes a second stage separating device, indicated generally by the reference numeral 169 (FIG. 10). Thus, as previously mentioned the mounting plate 140 is bifurcated to provide the downwardly opening recess 174 (FIG. 10) in order to accommodate a forwardly extending boss 176 suitably mounted on the cross bar 168. An adjusting screw 178 is mounted in an aperture formed in the boss 176 and is secured thereto by a jam nut 180. The screw 178 is also threaded into a forwardly extending tab 184 of a vertically extending gate member 186, which has a vertical slot 188 which accommodates a screw or rivet 189 (FIGS. 6 and 10) for the purpose of maintaining the gate member 186 in vertical alignment. It will be apparent that rotation of the screw 178 will cause the gate member 186 to move up or down within the limits of the slot 188. The gate member 186 has a tapered lower end 187 which terminates in a substantially pointed tip 190. The small tip is needed because the booklets may be somewhat wavy due to the poor quality of the paper, and therefore movement of the booklets could be obstructed by a wide gate, thereby causing a jam. The tip 190 is disposed adjacent the upper surface of the vacuum feed plate 40, and is adjustable with respect thereto by rotation of the screw 178 to accommodate booklets of varying thickness. It will also be seen that the operation of this second stage separating device is further described below in connection with the description of operation of the machine 10.

Figure 7:
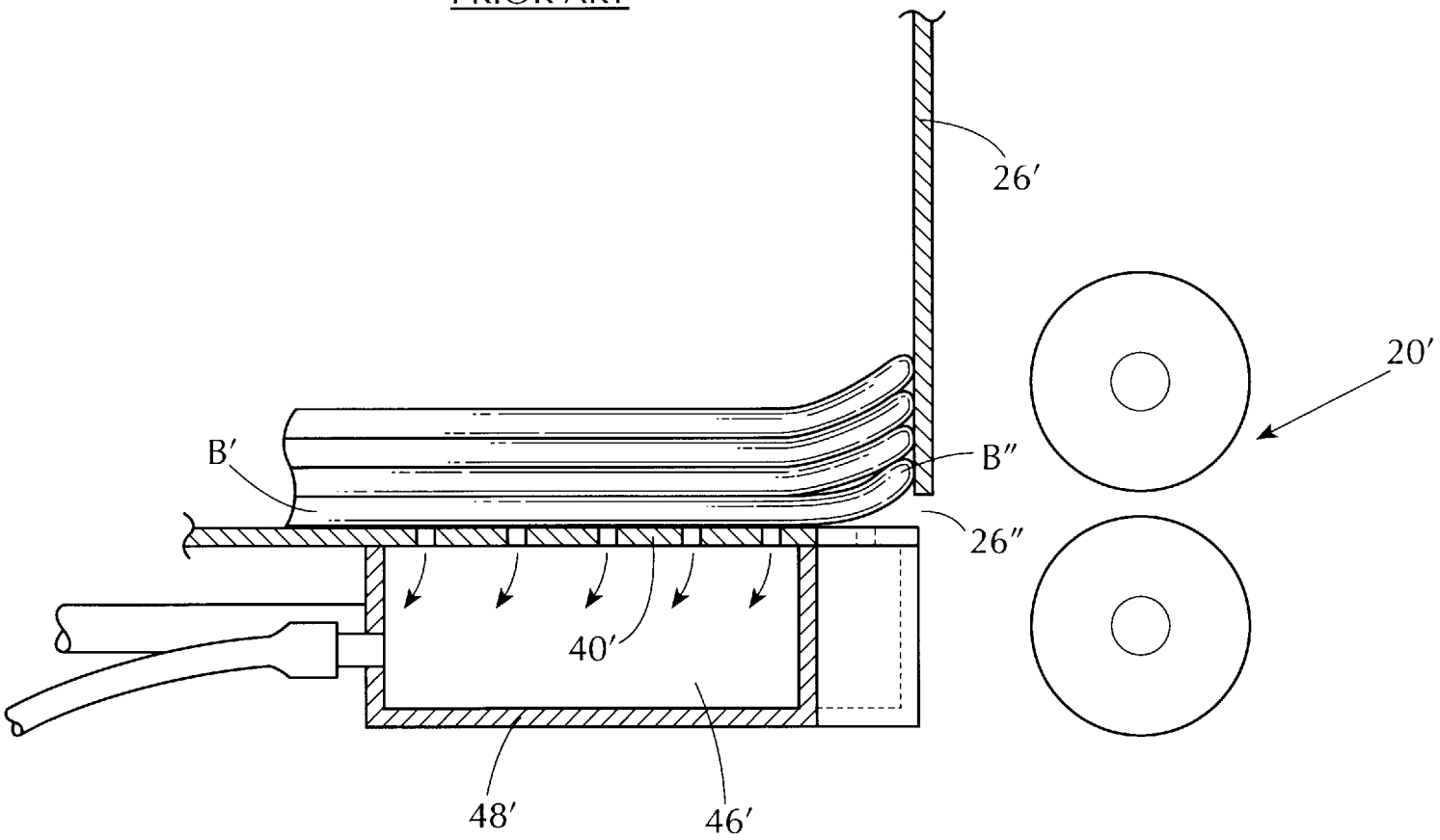
FIG. 7 PRIOR ART
FIG. 7 is a fragmentary sectional view drawn to an enlarged scale of only the lower portion of the supply hopper adjacent the discharge opening and the vacuum feeding means, illustrating the problem that occurs with the bottom booklet jamming in the discharge opening in the absence of a critical feature of the present invention.

Still referring to FIGS. 2, 7 and 10, the take away feeding device, indicated generally by the reference numeral 20 in FIG. 2, comprises a plurality feed rollers 192 fixedly mounted on a shaft 194 suitably mounted for rotation in the side frame member 162 and which is driven from the motor 89 by the belt 88 and the pulley 86. The casting 160 includes a plurality of forwardly extending tabs 196 which have apertures in which an elongate screw 198 is mounted for vertical movement, the lowermost position of which is controlled by an adjusting nut assembly 200. The lower end of the screw 198 is threaded into the cross arm 202 of a yoke 204 and is secured thereto by another lock nut 205 (FIG. 9), and a back up roller 206 is rotatably mounted in the yoke 204. A compression spring 208 is captured between the tab 196 and the upper surface of the lock nut 205 to normally urge the yoke 204 and the screw 198 downwardly. As will be seen below, depending on the thickness of a booklet passing between the feed rollers 192 and the back up roller 206, the back up rollers can move upwardly along with the screw 198 and the yoke 204, and the height of the roller 206 is controlled by the adjusting nut assembly 200.

As best seen in FIGS. 1 and 6, the rear wall 28 of the supply hopper 12 is provided with a supporting device, indicated generally by the reference numeral 210, the purpose of which is to support the rear edge portion of the stack of booklets in the supply hopper 12 so as to remove a substantial portion of the weight of the booklets in the stack from the bottom booklet, and also to impose a friction drag on the next to bottom booklet to reduce the tendency for that booklet to move with the bottom booklet, which could create a jam at the discharge opening 159. Thus, a mounting bracket having an elongate cross bar 212 and side flanges 214 is disposed on the inner surface of the rear wall 28, and is adjustably secured thereto by a thumb nut 216 threaded onto a screw 218 connected to the cross bar 212, the screw 216 passing through an elongate vertical slot 220 formed in the rear wall 28. A pair of arms 222 having elongate slots 224 at their upper ends are adjustably mounted on the side flanges 214 of the mounting bracket by means of threaded posts 226 which receive thumb nuts 228 by which the arms 222 are secured in a given vertical and angular position on the mounting bracket side flanges 214. A pair of friction members 230, illustratively shown in the shape of slotted rubber rollers, are fixedly mounted on the lower ends of the arms 222, and support the next to bottom booklet, and those above it, adjacent the rear edges thereof, as shown in FIG. 6. By appropriate vertical movement of the cross bar 212 on the slot 220, and both vertical movement of the arms 222 along the slots 224 and angular movement about the posts 226, it is possible to achieve universal adjustment of the position of the friction members 230 within the limits of the slot 220 on the rear wall 28 and the slots 224 on the arms 222, so as to place them in a position, depending on the width and the thickness of the booklets, in which maximum support and friction between the friction members 230 and the bottom booklet are achieved.

It should also be noted, as seen in FIG. 6, that the rear wall 28 is mounted on the bottom plate 34 at an angle thereto that is approximately equal to the angle of the guide plate 150, so that the vertical axis of the stack of booklets in the supply hopper is also disposed at the same angle in order to facilitate the separating and feeding of successive booklets in the manner further described below.

Reference is now made to FIG. 7 which illustrates the problem typically encountered in feeding bound booklets formed of relatively inexpensive, low quality, thin, flexible and flimsy paper, especially when the booklets are formed to have a relatively large format. It should be understood that this problem occurs to one degree of severity or another, with any type of feeding device that may be provided, whether vacuum, friction, or other booklet moving element that, in effect, grasps the bottom cover or sheet of a booklet for the purpose of moving the booklet toward the discharge opening. However, for convenience of illustration, the feeding device shown in FIG. 7 is similar to that employed in the machine 10 embodying the invention, and corresponding primed reference numbers are being used for convenient of recognition of parts already described. Thus, a front wall 26' of a suitable supply hopper is mounted in the machine such that the bottom edge thereof is spaced above the upper surface of a suitable document support, which may be a fixed plate or a movable vacuum feed plate 40' which supports a leading edge portion of a bottom booklet B', and which may or may not be combined with a fixed bottom plate 34' that supports the remaining portion of the bottom booklet B'. The bottom edge of the front wall 26' thereby defines a discharge opening 26" through which the bottom booklet B' must pass in order to be fed to any type of take away feeding device, represented in FIG. 7 by the feed roller assembly 20'. Thus, when the vacuum feed plate 40' and a suitable enclosure 48' are moved forwardly to feed the bottom booklet B' through the discharge opening 26", there is a certain amount of relative movement between the bottom cover and/or several bottom sheets of the booklet B' and the top cover and/or several top sheets thereof, due to the fact that the vacuum grasping the bottom cover forces it and the adjacent several sheets to move forwardly, while the weight of the stack of booklets resting on the top cover tends to restrain the top cover and the adjacent several sheets against movement. If the booklet were formed of high quality paper, and/or of relatively small format, the booklet might be sufficiently rigid that it would remain flat and therefore would feed through the discharge opening in a flat configuration without difficulty. But with the low quality paper, and especially in a large format, the aforementioned relative movement of the top and bottom covers and adjacent sheets causes the bound edge of the booklet to curl upwardly and engage the inner surface of the bottom portion of the front wall 26', as indicated at B" in FIG. 7, thereby obviously preventing the booklet B' from passing through the discharge opening 26". The flimsy nature of the paper is such that this occurs even with the weight of the other booklets in the stack pressing on the bottom booklet, because the upward curl of the lead edge of the bottom booklet occurs with sufficient force that it compresses and curls the leading edge portions of the next two or three booklets. This permits the lead edge portion of the bottom booklet to curl sufficiently to prevent it from passing through the discharge opening. Thus, the booklet B' jams in the discharge opening 26" and does not reach the take away feeding device 20', thereby causing a shut down of the entire feeding machine and whatever other document processing apparatus may be associated with the feeding machine.

With reference now to the preceding figures, and now including FIGS. 8 and 9, a complete cycle of operation of the separating and feeding machine 10 will now be described. As best seen in FIG. 6, a plurality of bound booklets are placed in the supply hopper 12 with the bound edges thereof facing toward the slanted guide plate 150 of the first stage stacking and separating device 130, so that the booklets are arranged in a slightly shingled manner with a lead portion of each booklet being exposed beyond the lead edge of the next adjacent upper booklet. The bottom booklet B may be disposed flat on the bottom plate 34, but the next adjacent three or four booklets would be disposed with the trailing edges thereof resting on the friction members 220 so as to remove a substantial portion of the weight of the stack of booklets from the bottom booklet B. In a standby mode of the machine 10, the vacuum plate 40, with the vacuum enclosure 48, and all the parts connected thereto, i.e., rods 60, cross bar 64, bracket 68, lever 72, flag 114 and arm 116, are in their rearward most positions, with the vacuum plate 40 under a forward portion of the bottom booklet B adjacent the bound edge thereof, as seen in FIG. 6, and the pin 95 on the output element 90 of the one revolution clutch assembly 82 is engaged with the pin 96 so as to prevent rotation of the output element 90, as seen in FIG. 4.

As insert material is fed along the document processing apparatus 22 by the conveyor 24 underneath the machine 10, the microprocessor of the apparatus 22 causes an appropriate signal to be sent to the machine 10 to commence a cycle of operation which will deliver a booklet onto the conveyor 24 in properly timed relationship with the arrival of the other insert material at the discharge end of the machine 10. Thus, when this signal is given, the solenoid 106 is energized to withdraw the plunger 104 into the solenoid 106 against the bias of the spring 108, thereby moving the block 98 toward the right to move the pin 96 in the same direction and out of abutting engagement with the pin 95 projecting from the output element 90 of the one revolution clutch assembly 82, as seen in FIG. 4. The solenoid 106 has appropriate known circuitry to maintain it energized long enough to enable the pin 95 to pass the pin 96, after which the solenoid will be deenergized to the permit the pin 96 and associated parts to return to the positions shown in FIG. 5 under the urging of the spring 108 The disengagement of the pin 95 with the pin 96 permits the output element 90 to commence rotation, which drives the shaft 76 and the wheel 74 in a counter clockwise direction as indicated by the arrow B in FIG. 3. This causes the lever 72 to move in an orbital path which, in turn, causes the bracket 68 to move linearly in a forward direction, i.e., toward the front wall 26 of the supply hopper 12 and the gate element 192, also seen in FIG. 3. This movement of the bracket 68 also moves all of the parts connected thereto, i.e., the cross bar 64, rods 60 and vacuum enclosure 48 and vacuum plate 40, in the same direction.

It will be understood that during this movement, a vacuum has been applied to the enclosure 48 by virtue of the flag 116 having been recognized by the sensor 118 at the conclusion of the previous feeding cycle, and at that time, having energized the control element 56 to connect the hose 52 to the vacuum pump 54. Thus, the vacuum plate 40 grasps the bottom cover or sheet of the bottom booklet B to commence movement of the thereof toward the discharge opening defined by the upper surface of the vacuum plate 40 and the lower surface of the end portion 158 of the curvature 156 formed on the bottom of the guide plate 150, as best seen in FIGS. 8 and 9.

The pressing member 146 has been vertically positioned within the groove 147 so that the bottom edge 149 presses on the upper surface of the curved portion 156 of the strip 152 adjacent the end 158 thereof so that, as best seen in FIG. 8, the end 158, and a small portion of the curvature 156 bears directly on the upper surface of the lead edge portion of the bottom booklet B, even before there is any forward movement of the booklet. This is possible by virtue of the fact that the angle of the guide plate 150 and the rear wall 28 cause the bottom several booklets to like in the hopper 12 in a shingled relationship, as clearly seen in FIG. 8. Thus, as the vacuum plate 40 moves forwardly with the bottom booklet B, the lower end portion of the curvature 156 presses downwardly on the lead edge portion of the booklet, thereby effectively preventing the upward curling of the lead edge portion of the booklet shown in FIG. 7, and permitting the lead edge of the booklet B to pass through the discharge opening 159.

The gate member 186 has also be vertically adjusted by rotation of the screw 181 so that the bottom 190 of the gate member 186 is disposed in approximately the same vertically spaced relationship with the upper surface of the vacuum feed plate 40 as is the end 158 of the strip 152. Thus, the gate member 186 forms, in effect, an extension of the discharge opening 159 and provides further assurance that only one booklet can be discharged at a time through the discharge opening 159. It also functions to maintain a downward force on the edge portion of the booklet until the lead edge thereof is past the gate member, after which there has been sufficient movement of the booklet that there is little, if any, tendency for the lead edge portion thereof to curl upwardly, and the lead edge thereof will enter the nip of the rollers 192 and 206 in a substantially tangentially aligned manner.

The vacuum plate 40 will have completed its forward motion when the lead edge of the booklet B is grasped by the rollers 192 and 206. At that instant, the flag 116 will be recognized by the forward sensing device 120, the exact position of which has been adjusted so that the vacuum is effectively shut off and the enclosure 48 vented to atmosphere in timed synchronism with the rollers 192 and 206 grasping the lead edge of the booklet. Thereafter, the wheel 74 continues to rotate through the remaining portion of the revolution so as to move the cross bar 64 and all the parts connected thereto in the opposite direction, thereby returning the vacuum feed plate to its initial position to reestablish the vacuum through the sensing device 118 and the vacuum control element 56, thereby completing a cycle of operation of the machine 10.

It is to be understood that the present invention is not to be considered as limited to the specific embodiment described above and shown in the accompanying drawings, which is merely illustrative of the best mode presently contemplated for carrying out the invention and which is susceptible to such changes as may be obvious to one skilled in the art, but rather that the invention is intended to cover all such variations, modifications and equivalents thereof as may be deemed to be within the scope of the claims appended hereto.

We claim:

1. A separating and feeding machine for removing a succession of bound booklets seriatim from a supply hopper adapted to hold a stack of said booklets for feeding to a subsequent apparatus for further processing of said booklets, said separating and feeding machine comprising:

A. a supply hopper for holding a stack of said booklets, said supply hopper having upstanding front, rear and side walls and a bottom supporting plate, said booklets being in said hopper with the bound edges thereof facing said front wall, B. means operatively associated with said front wall defining a discharge opening from said supply hopper adjacent said bottom supporting plate, C. take away feeding means mounted adjacent said discharge opening for grasping said bound edges of said booklets as said booklets pass through said discharge opening, D. vacuum feeding means movably mounted on said supporting plate for grasping the bottom booklet of said stack adjacent the bound edge thereof and moving said bottom booklet sufficiently far through said discharge opening for said take away feeding means to grasp said bound edge to withdraw said booklet from said hopper, and E. booklet separation means operatively associated with said supply hopper having first stage separating means for obstructing movement of the next to bottom booklet while said bottom booklet is moving through said discharge opening and simultaneously for maintaining a normal force on said bottom booklet adjacent said bound edge during said movement of said bottom booklet through said discharge opening, and second stage separating means for permitting only one booklet at a time to pass through said discharge opening, whereby successive bottom booklets are fed seriatim from said stack to said take away feeding means without becoming wrinkled and jamming in said discharge opening.

2. A separating and feeding machine as set forth in claim 1 wherein said vacuum feeding means comprises a vacuum feed plate having apertures therethrough on which a portion of the bottom sheet of the bottom booklet adjacent said bound edge rests.

3. A separating and feeding machine as set forth in claim 2 wherein said vacuum feeding means further comprises means mounting said vacuum feed plate for limited reciprocatory movement relative to said discharge opening between a first position in which said vacuum feed plate grasps said bottom booklet adjacent said bound edge thereof, and a second position in which said take away feeding means grasps said bound edge of said booklet.

4. A separating and feeding machine as set forth in claim 3 wherein said vacuum feeding means further comprises control means for applying a vacuum to said vacuum feed plate when said vacuum feed plate is in said first position so as to cause said vacuum feed plate to grasp said bottom sheet of said bottom booklet, and for removing the vacuum from said vacuum feed plate when said vacuum feed plat is substantially in said second position to release said bottom booklet to permit said take away feeding means to withdraw said booklet from said supply hopper.

5. A separating and feeding machine as set forth in claim 4 wherein said vacuum control means comprises A. sensing means for sensing the arrival of said vacuum feed plate alternately at said first and second positions, and B. a control element responsive to said sensing means sensing the arrival of said vacuum feed plat at said first and second positions for alternately connecting and disconnecting said vacuum feed plate to and from a source of vacuum.

6. A separating and feeding machine as set forth in claim 3 wherein said vacuum feeding means further comprises drive means for causing said vacuum feed plate to complete only one cycle of said reciprocatory movement from said first position to said second position and back to said first position each time said drive means receives a demand feed signal from another apparatus operatively associated with said separating and feeding machine.

7. A separating and feeding machine as set forth in claim 6 wherein said drive means comprises A. means providing a continuously operating input drive, B. cyclically operable drive means for driving said vacuum feed plate through successive cycles of operation, and C. single cycle clutch means interposed between said continuously operating input drive and said cyclically operable drive means and responsive to said demand feed signal from said other apparatus for operating said cyclically operable drive means to cause said cyclically operable drive means to drive said vacuum feed plate through said one cycle of operation.

8. A separating and feeding machine as set forth in claim 3 wherein said vacuum feed plate has a forwardly opening slot formed adjacent the front edge of said vacuum feed plate, and said apertures are disposed in two spaced apart parallel rows on either side of said slot.

9. A separating and feeding machine as set forth in claim 1 wherein said first and second stage separating means are operatively associated with said front wall adjacent said discharge opening.

10. A separating and feeding machine as set forth in claim 9 wherein said first stage separating means comprises means for maintaining at least the bottom and next to bottom booklets of said stack in a shingled relationship to expose a marginal portion of the top sheet of said bottom booklet adjacent said bound edge thereof, and means for maintaining said normal force on said exposed edge of said bottom booklet during movement of said bottom booklet toward said discharge opening by said vacuum feeding means.

11. A separating and feeding machine as set forth in claim 10 wherein said means for maintaining said normal force on said bottom booklet comprises means mounted on said first stage separating means for pressing on the upper surface of said curved portion of said abutment member adjacent the lower terminal edge thereof so that the lower surface of said curved portion of said abutment member presses downwardly on said top sheet of said bottom booklet during movement thereof toward said discharge opening.

12. A separating and feeding machine as set forth in claim 11 wherein said means for pressing on said upper surface of said curved portion of said abutment member comprises an actuating member mounted in said first stage separating means in substantial vertical orientation and having a lower edge pressing on said upper surface of said curved portion of said abutment member to press said lower surface of said abutment member into firm engagement with said top sheet of said bottom booklet.

13. A separating and feeding machine as set forth in claim 12 wherein said first stage separating means further includes means for adjustably mounting said actuating member for axial movement thereof so as to vary the extent of said normal force applied by said curved portion of said abutment member so said upper sheet of said bottom booklet.

14. A separating and feeding machine as set forth in claim 10 wherein said first stage separating means further comprises first and second elongate walls disposed at an angle to each other that converges toward the lower ends of said walls, means joining said walls together to form a composite unit, and means disposed on one of said walls for removably mounting said composite unit on said front wall of said hopper.

15. A separating and feeding machine as set forth in claim 14 wherein said means for maintaining at least the bottom and next to bottom booklets of said stack in a shingled relationship is mounted on the wall remote from the wall on which said mounting means is disposed.

16. A separating and feeding machine as set forth in claim 15 wherein said means for maintaining said normal force on said exposed edge of said bottom booklet is mounted on said one wall that said mounting means is disposed on.

17. A separating and feeding machine as set forth in claim 10 wherein said means for maintaining at least the bottom and next to bottom booklets of said stack in a shingled relationship comprises an elongate, generally upright abutment member having a lower end in closely spaced relationship with a forward projection of said vacuum feeding means so that only one booklet can pass under said abutment member by said vacuum feeding means, said abutment member being formed with a curved portion adjacent at least said next to bottom booklet and extending toward said discharge opening to define an abutment surface for at least said next to bottom booklet which prevents the leading edge of said next to bottom booklet from overlying the leading edge of said bottom booklet when said bottom booklet is lying flat on said vacuum feeding means.

18. A separating and feeding machine as set forth in claim 17 wherein said first stage separating means further includes means for adjustably mounting said abutment member for axial movement thereof so as to vary the distance between said lower end of said abutment member and said forward projection of said vacuum feeding means to accommodate booklets of varying thickness.

19. A separating and feeding machine as set forth in claim 1 wherein said second stage separating means comprises a generally vertically oriented gate having a lower end disposed in closely spaced relationship with a forward projection of said vacuum feeding means so that only one booklet can pass under said gate by said vacuum feeding means.

20. A separating and feeding machine as set forth in claim 19 wherein said lower end of said gate is tapered downwardly to form a substantially pointed tip.

21. A separating and feeding machine as set forth in claim 19 wherein said second stage separating means further includes means for adjustably mounting said gate for axial movement thereof so as to vary the distance between said lower end of said gate and said forward projection of said vacuum feeding means to accommodate booklets of different thickness.

22. A separating and feeding machine as set forth in claim 1 wherein said booklet separation means further comprises means mounted on said rear wall of said hopper for supporting the rear edges of the next to bottom booklet and all booklets in said stack thereabove in an elevated position to substantially reduce the weight of said stack of booklets resting on said bottom booklet.

23. A separating and feeding machine as set forth in claim 22 wherein said supporting means comprises a friction member which imposes a resistance to movement of said next to bottom booklet adjacent the rear edge thereof to reduce the tendency of said next to bottom booklet to move with said bottom booklet when said bottom booklet is being fed by said vacuum feeding means.

24. A separating and feeding machine as set forth in claim 23 wherein said supporting means includes vertical and angular adjusting means for said friction member for permitting the position of said friction member with respect to said rear edge of said next to bottom booklet to be universally adjusted within the limits of said vertical and angular adjusting means to achieve maximum support and friction between said friction member and said next to bottom booklet.

* * * * *